US006725575B2

(12) United States Patent
Curet

(10) Patent No.: US 6,725,575 B2
(45) **Date of Patent: *Apr. 27, 2004**

(54) APPARATUS AND METHOD OF LACING

(75) Inventor: William D. Curet, Lake Charles, LA (US)

(73) Assignee: Sporting Innovations Group, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/295,520

(22) Filed: Nov. 14, 2002

(65) Prior Publication Data

US 2003/0056398 A1 Mar. 27, 2003

Related U.S. Application Data

(63) Continuation of application No. 09/821,815, filed on Mar. 29, 2001, now abandoned, which is a continuation of application No. 09/121,722, filed on Jul. 25, 1998, now Pat. No. 6,282,817.

(51) Int. Cl.[7] ..... A43C 11/00

(52) U.S. Cl. ..... 36/50.1; 24/712.2; 24/712.1; 24/712.3; 24/712.6

(58) Field of Search ..... 36/50.1, 50.5; 24/712.2, 712.1, 712.3, 712.6, 713.6, 714.6, 715.1, 715.3, 715.6, 115 H

(56) References Cited

U.S. PATENT DOCUMENTS

| | | | | |
|---|---|---|---|---|
| 652,647 A | | 6/1900 | Soderberg | |
| 849,921 A | | 4/1907 | Schelling | |
| 1,247,398 A | | 11/1917 | Hanley | |
| 3,132,390 A | | 5/1964 | Boden | 24/30.5 |
| 3,296,669 A | | 1/1967 | Elder, Jr. | 24/121 |
| 3,564,670 A | | 2/1971 | Bengtsson | 24/126 |
| 3,845,575 A | | 11/1974 | Boden | 36/50 |
| 3,965,544 A | | 6/1976 | Boden | 24/136 R |
| 4,102,019 A | | 7/1978 | Boden | 24/117 |
| 4,200,998 A | | 5/1980 | Adams | 36/50 |
| 4,553,293 A | * | 11/1985 | Blum | 24/712.2 |
| 4,715,094 A | * | 12/1987 | Herdman | 24/712.3 |
| 4,949,437 A | * | 8/1990 | Anderson | 24/712.2 |
| 5,023,982 A | | 6/1991 | Mehan | 24/715.3 |
| 5,195,783 A | * | 3/1993 | Lavoie | 283/75 |
| 5,293,675 A | | 3/1994 | Shai | 24/712.1 |
| 5,388,315 A | | 2/1995 | Jones | 24/712.1 |
| 5,477,593 A | | 12/1995 | Leick | 24/712.5 |
| 5,572,770 A | | 11/1996 | Boden | 24/136 R |
| 5,572,778 A | | 11/1996 | Stenner et al. | 24/712.9 |
| 5,657,557 A | | 8/1997 | Hull et al. | 36/58.5 |
| 5,697,128 A | | 12/1997 | Peregrine | 24/115 G |
| 5,884,419 A | | 3/1999 | Davidowitz et al. | 36/11 |
| 5,937,542 A | | 8/1999 | Bourdeau | 36/10 |
| 6,282,817 B1 | * | 9/2001 | Curet | 36/50.1 |
| 6,338,186 B1 | | 1/2002 | Kleinmann | 24/712.2 |

FOREIGN PATENT DOCUMENTS

GB 10881 of 1891

* cited by examiner

*Primary Examiner*—Jila M. Mohandesi
(74) *Attorney, Agent, or Firm*—Nelson Mullins Riley & Scarborough, L.L.P.

(57) ABSTRACT

A lacing apparatus comprising a lace having a first and a second end and of sufficient length to be threaded through a plurality of apertures defined by at least two portions of one or more articles. The lacing apparatus also comprises a locking collar having respective input and output apertures that receive the first and second ends of the lace, and which the first and second ends of the lace pass, respectively. The locking collar releasably secures the lace inward on the length of the lace from at least one of the first and second ends. A locking mechanism is adapted to releasably receive the lace so that a portion of the lace forms a loop between the first and second end of the lace at a first end of the locking mechanism, and the locking mechanism is adapted to adjust the length of the loop.

31 Claims, 4 Drawing Sheets

APPARATUS AND METHOD OF LACING

CROSS-REFERENCE TO RELATED APPLICATIONS

The present application is a continuation of, and claims priority to, U.S. patent application Ser. No. 09/821,815, filed on Mar. 29, 2001, now abandoned, which is a continuation of U.S. patent application Ser. No. 09/121,722, filed on Jul. 25, 1998, issued as U.S. Pat. No. 6,282,817.

TECHNICAL FIELD OF THE INVENTION

The present invention relates to apparatus and methods for releasably securing two or more objects, or portions thereof, in proximity with one another by employing at least one lace which is threaded through two or more apertures defined by the objects or portions thereof.

BACKGROUND OF THE INVENTION

Articles which each employ a lacing system to releasably secure two or more portions of the article in proximity with one another have long required that the user tie together the free end portions of a lace which has been threaded through a plurality of eyelets in respective portions of the article. In footwear, for example, the lace typically is first threaded through eyelets in respective halves of an upper portion of the footwear, and the halves are synched together by pulling upon the free end portions of the threaded lace. Once the halves have been synched together as desired, the user ties together the free end portions of the lace to prevent the upper portion halves from spreading apart, thereby securing the footwear to the foot. While alternative configurations are known which do not employ a threaded lace to releasably secure two or more portions of an article together, footwear and other articles which employ such a lacing system remain popular for many reasons, including their ability to firmly and adjustably secure portions of the subject article together.

Unfortunately, many articles which employ one or more laces for these purposes put the user to the inconvenience of having to tie the free end portions of the threaded lace together to maintain a secure fit during use of the article. Often, the free end portions become untied inadvertently, causing the user inconvenience and creating a potentially hazardous condition should the user step upon one of the free end portions while walking or running. Where time is critical, such as for example during athletic competition, the burden of retying the loose free end portions of a shoelace can prove to be detrimental. To prevent lace from becoming untied during use, multiple knots often are used to tie together the free end portions, which in turn further complicates the process of untying the free end portions and removing the footwear when desired. Moreover, for those who lack the ability or inclination to tie and untie the free end portions of the lace, footwear which incorporates a lace configuration may not be feasible or appealing.

U.S. Pat. No. 3,296,669 to Elder, Jr. discloses footwear which does not require the user to tie the free ends of a shoelace. While the configuration disclosed therein has certain advantages over other types of laced footwear, the lacing system described requires the use of fixed tabs at the free ends of the shoelace to prevent the free ends from being pulled through the eyelets when the shoelace is pulled by the user. Such fixed tabs do not enable the user to adjust the length of the shoelace without causing damage to the structure which retains the lace within the eyelets. The disclosed locking device further requires the user to employ sufficient dexterity to align the lace along a path formed by the locking device and to press the lace in between prongs which define the path in order to secure the lace in place.

Thus, a need still exists for efficient lacing apparatus which does not depend upon the user to tie and/or untie the free end portions of the lace and yet permits the free ends of the lace to be rigidly yet adjustably connected to one another while providing the advantages of a threaded lace for securing footwear to a foot.

BRIEF SUMMARY OF THE INVENTION

The present invention is deemed to satisfy this need in a highly efficient and novel way. In one embodiment, this invention provides lacing apparatus which comprises (a) a lace which may be threaded through a plurality of apertures defined by at least two portions of one or more articles; (b) a collar for connecting the free ends of the lace to one another, so that when the free ends of the lace are connected to one another, the lace forms a continuous loop; and (c) mechanical locking means (e.g., a wheel lock-type cord fastener) for receiving the lace and releasably locking at least two portions of the lace in proximity to one another when at least a portion of the lace has been threaded through the apertures and the free ends of the lace are connected to one another.

The articles, portions of which define the apertures through which the lace is threaded, may be comprised of a wide variety of objects including virtually anything which may be releasably laced together. Suitable non-limiting examples include bags, blouses, skirts, girdles, footwear, medical support straps, and the like. Footwear is a particularly suitable article, non-limiting examples of which include one or more shoes, boots, sandals, etc. For convenience only, the preferred embodiments of this invention will be illustrated hereinafter as applied to footwear.

Preferably, the connecting means is a clamp, and more preferably the clamp comprises two halves of a hollow, open-ended cylinder, each of the two halves being connectable to one another so that, when connected, the halves may form the hollow cylinder, and wherein the clamp further comprises lace retention means (e.g., one or more spiked flanges) for retaining at least a portion of each of the free end portions of the lace within the hollow cylinder. In another preferred embodiment, the clamp further comprises a secondary flange extending radially outwardly from the outer surface of the hollow cylinder for receiving and retaining an unlaced portion of the continuous loop formed by the lace, and one of the halves of the hollow cylinder defines an aperture through which the free ends of the lace may be threaded In this way, a user may access the free ends of the lace once threaded through the aperture and cut or otherwise remove excess length from the lace to thereby adjust the length of the lace which effectively forms the continuous loop.

Another embodiment of this invention provides footwear which comprises (a) a sole; (b) an upper footwear portion connected to the sole and defining two or more apertures; (c) a lace which may be threaded through the apertures; (d) connecting means for connecting the free ends of the lace together to form a continuous loop; and (e) mechanical locking means for receiving the lace and releasably locking at least two portions of the lace in proximity to one another when at least a portion of the lace has been threaded through the apertures and the free ends of the lace are connected to one another.

In yet another embodiment of this invention, a method of releasably securing two or more objects together is provided. The method comprises (a) threading a lace through (1) mechanical locking means for receiving the lace and releasably locking at least two portions of the lace in proximity to one another and (2) through two or more apertures formed by the objects, (b) connecting together the free ends of the lace to form a continuous loop, (c) pulling upon the threaded lace so as to bring the objects into proximity with one another, and (d) securing the mechanical locking means so as to releasably lock the lace portions in proximity to one another, thereby inhibiting separation of the objects.

These and other embodiments and features of the present invention will become still further apparent from the ensuing descriptions, appended claims and accompanying drawings.

BRIEF DESCRIPTION OF THE DRAWINGS

In each of the above figures, like numerals are used to refer to like or functionally like parts among the several figures.

DETAILED DESCRIPTION OF THE DRAWINGS

As may now be appreciated by one skilled in the art, the present invention enables portions of one or more articles to be brought into proximity with one another and releasably yet securely retained in such position through the use of lace, all without requiring the tying of free ends and without the inconvenience and potential hazard presented by dangling free ends of a lace. The present invention also enables the threaded lace to be secured in place efficiently and durably and into the form of a continuous loop to facilitate the use of the lace.

Referring now to the accompanying drawings, FIGS. 1–4 illustrate a preferred embodiment of this invention.

Figure 1:
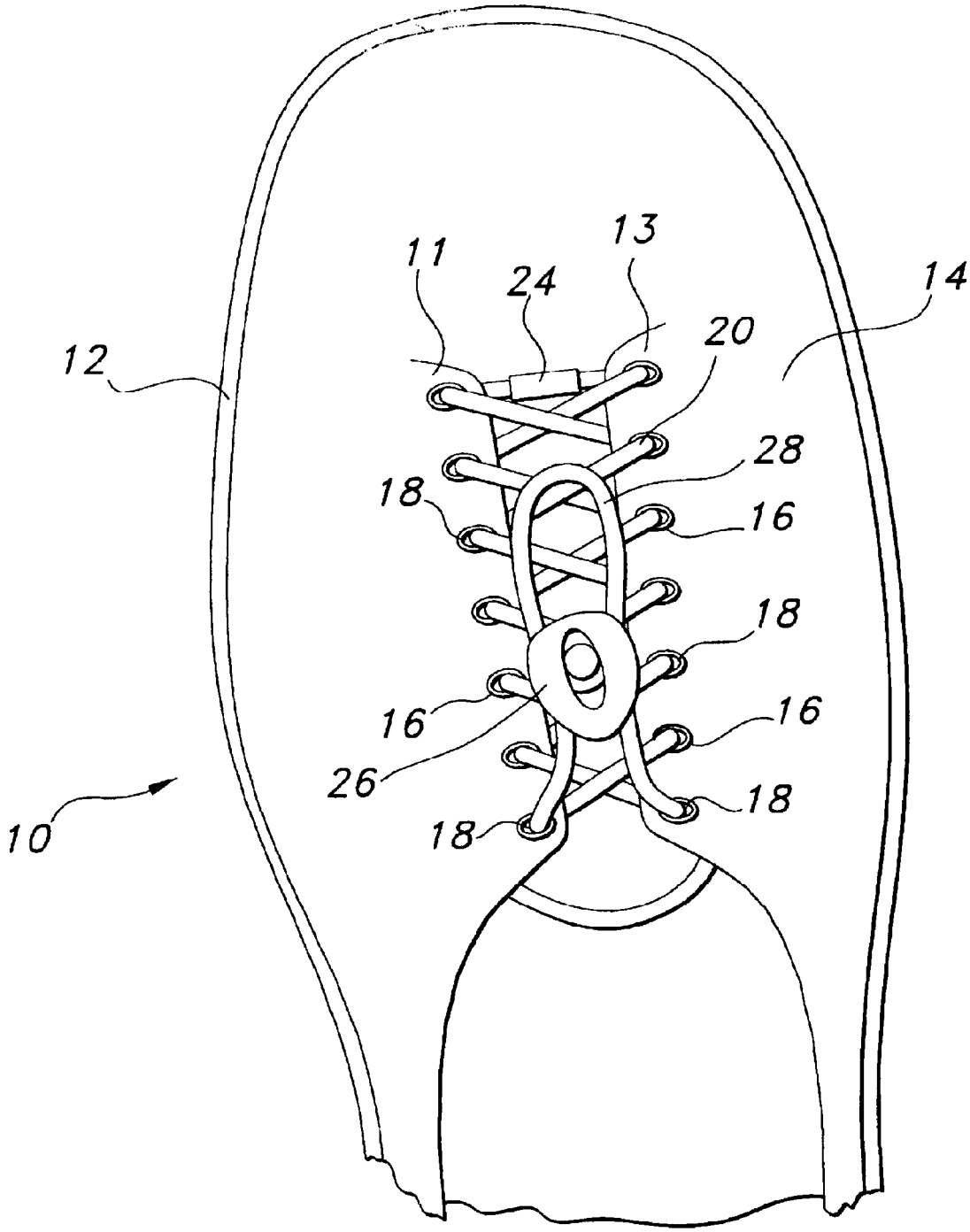
FIG. 1 is a top view in perspective of a shoe which incorporates a preferred lacing apparatus of this invention.

FIG. 1 illustrates one view of apparatus of this invention which has been installed on footwear in the form of a shoe 10, partially broken away. As depicted, shoe 10 is comprised of a sole 12 and an upper footwear portion 14 connected thereto. Upper footwear portion 14 includes two flap portions 11 and 13, which in turn include a plurality of eyelets 16 so that portions 11 and 13 define a plurality of apertures 18 through which a lace 20 has been threaded. Lace 20 has two free ends 22, 22 which, although not required, are proximate to the front end, i.e., the end opposite from the heel (not shown) of shoe 10, and which are connected to one another by connecting means in the form of a plastic clamp 24, thereby placing lace 20 in the form of a continuous loop.

Figure 5:
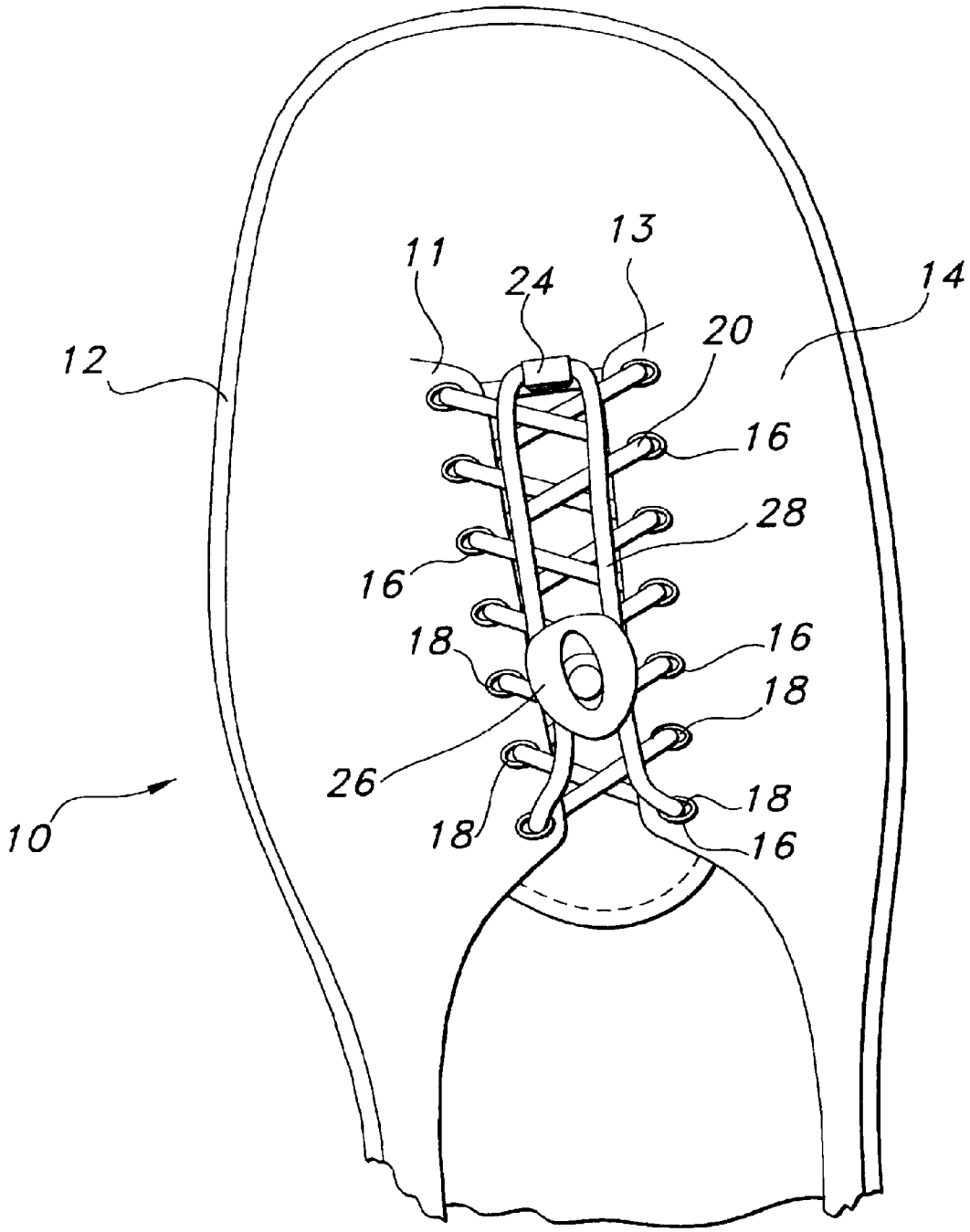
FIG. 5 is a top view in perspective of a shoe which incorporates another preferred lacing apparatus of this invention.
Figure 6:
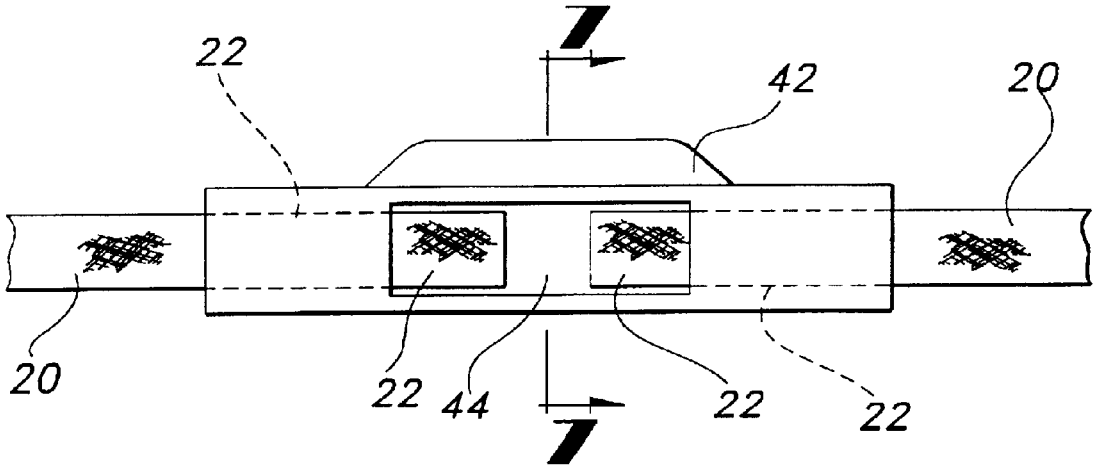
FIG. 6 is a plan view of a component part of the apparatus of FIG. 5.

Lace 20 also is threaded through mechanical locking means in the form of a wheel lock-type cord fastener 26, the configuration of which is fully described in U.S. Pat. No. 3,564,670 to Bengtsson. An example of a similarly suitable fastener of this type may be seen in U.S. Pat. No. 5,477,593 to Leick. Leick discloses a locking device for a lace. The locking device includes a body, a circular shaped locking wheel, and a pusher. A cavity within the body receives the wheel and allows the wheel to move longitudinally with respect to the body. The pusher attaches to the wheel and actuates the wheel along the length of the body. As shown in FIGS. 5 and 6 of Leick, each end of a lace are fed through an input aperture and an output aperture so that the lace is located between the locking wheel and an inside wall of the body. The locking of the strands of the laces occurs by a wedging effect via the cooperation of the body and the wheel. Fastener 26 receives the lace and is configured to releasably lock at least two portions of lace 20 in proximity with one another, to thereby secure the lace, and in turn the portions of footwear upper portion 14 through which the lace is threaded, together. A loop segment 28 extends from fastener 26.

Figure 2:
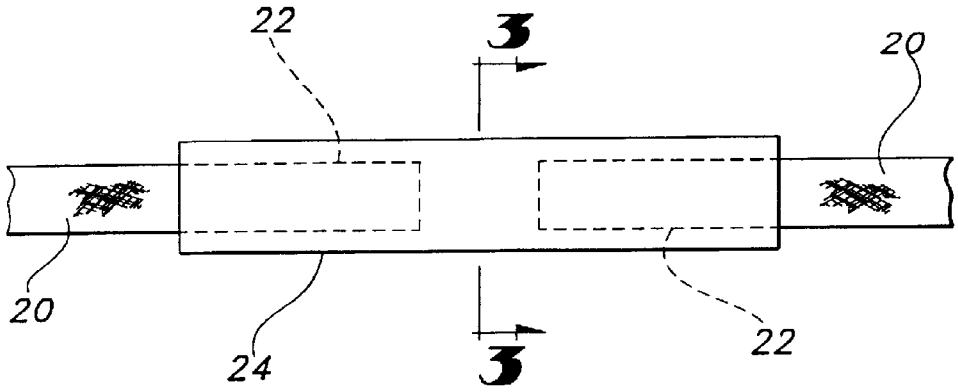
FIG. 2 is a plan view of a component part of the apparatus of FIG. 1.
Figure 3:
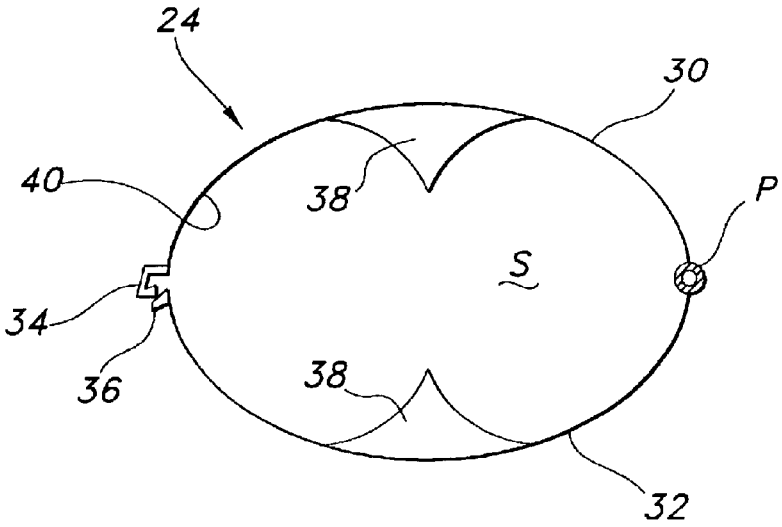
FIG. 3 is a cross-section of the component part of FIG. 2 taken along line 3—3 in FIG. 2.
Figure 4:
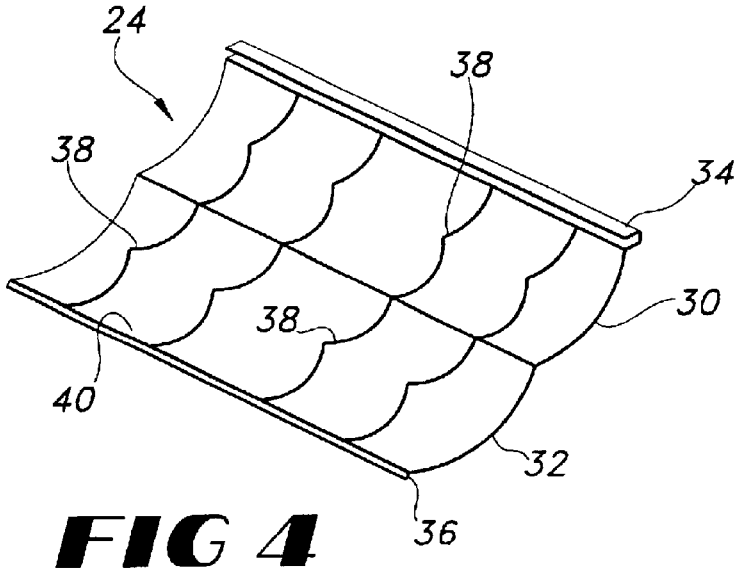
FIG. 4 is an elevated view in perspective of the component part of FIG. 2.

With particular reference to FIGS. 2–4, it may be seen that clamp 24 is in the shape of an open-ended hollow cylinder formed from two halves 30 and 32 which are hinged together along respective longitudinal edges so as to pivot relative to one another about a longitudinal axis represented in cross-section on FIG. 3 as pivot point P. Halves 30 and 32 may be clamped together by a snap fit provided by beveled flanges 34 and 36 which extend longitudinally along the respective edges of halves 30 and 32 which are opposite the hinged connection. Clamp 24 further comprises lace retention means in the form of a plurality of spiked flanges 38 which extend from an inner surface 40 of the hollow cylinder formed by halves 30 and 32 into the space S within the hollow cylinder. This particular clamp is especially preferred because it provides the advantage of a streamline connection between the free ends of the lace to prevent hang ups between the clamp and surrounding material during use, and yet it also provides a secure connection between the free ends of the lace. Without being bound by theory, it is thought that the pulling force exerted on the lace and transferred therethrough typically is less inclined to cause this clamp to open inadvertently on account of the linear longitudinal relationship between the lace and the clamp.

Figure 7:
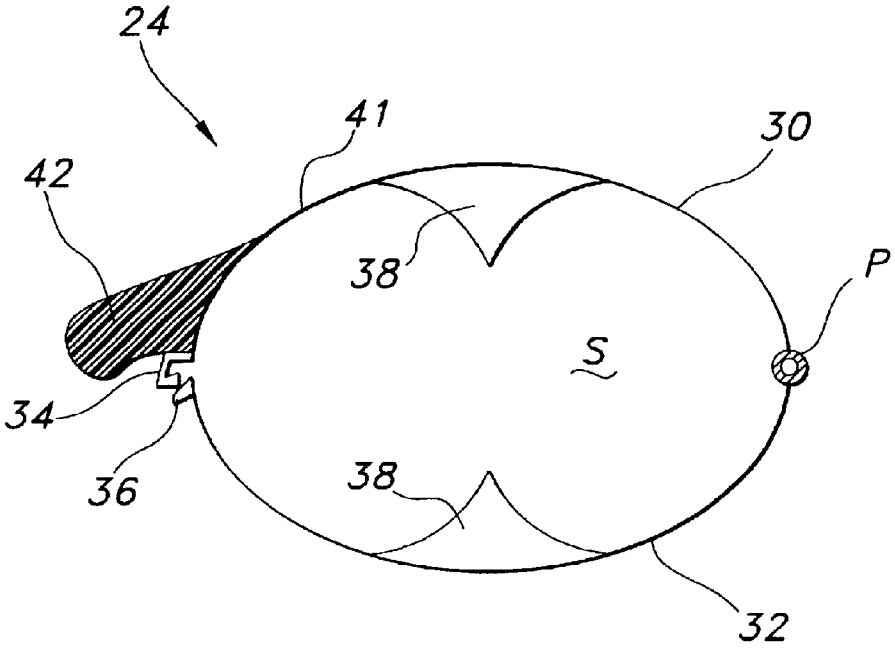
FIG. 7 is a cross-section of the component part of FIG. 6 taken along line 7—7 in FIG. 6.

FIGS. 5–7 illustrate another preferred embodiment of the present invention. This embodiment differs from that illustrated in FIGS. 1–4 in the design and configuration of clamp 24. As depicted in FIGS. 5–7, half 30 of clamp 24 has been modified so that a secondary flange 42 extends out radially from an outer surface 41 of the hollow cylinder formed by half 30. In addition, half 30 defines an elongate aperture 44 through which free ends 22, 22 of lace 20 are visible in FIG. 6. Flange 42 is curved in cross-section to facilitate the retention of loop segment 28 of lace 20, as seen on FIG. 5. In this way, loop segment 28 may be retained to prevent it from dangling to the side of shoe 10, if desired. Alternatively, or in addition, free ends 22, 22 may be threaded through aperture 44 and cut to adjust the overall length of lace 20 to reduce the size of loop segment 28, thereby reducing the need to retain segment 28 and preventing it from dangling to the side of shoe 10. It will now be appreciated that the secondary flange may take on one of many forms, and such form is no limitation of this invention so long as the secondary flange is capable of retaining the lace to prevent the loop segment from dangling to the side of the shoe.

It will be appreciated by those of ordinary skill in the art that the connecting means of this invention may comprise a wide variety of mechanical devices, including but not limited to snaps, male-to-female twist locks, hook-and-loop-type material, and the like. Preferably, the connecting means comprises a clamp, as described with particularity above. Those of ordinary skill in the art will also appreciate that the lace retention means of this invention may be comprised of a wide variety of devices, non-limiting examples of which include snaps, hooks, straps, and the like. However, the lace retention means preferably comprises a secondary flange as described in detail above.

Furthermore, those of ordinary skill in the art now will appreciate that the mechanical locking means of this invention may comprise a wide variety of mechanical devices, including but not limited to various locks, clamps, fasteners and the like. Preferably, the mechanical locking means comprises a cord fastener, and most preferably comprises a wheel lock-type cord fastener as described in detail hereinabove.

The lace of this invention may comprise virtually any strand-like material or conventional lace material which may be connected at its free ends using connecting means of this invention, but preferably comprises a strand of elastic material. More preferably, the elastic material is synthetic rubber. In a particularly preferred embodiment, the lace is comprised of a segment of shock cord which is easily threaded and is elastic along its longitudinal axis, and yet includes a sturdy outer surface of woven nylon or other stretchable yet durable material which may enhance the useful life of the lace.

In the practice of the methods of this invention, and with reference to the preferred embodiments depicted in the accompanying FIGS. 1–7, two or more objects in the form of two portions 11 and 13 of upper footwear portion 14 may be releasably secured together by threading lace 20 through mechanical locking means, in the form of fastener 26 and through apertures 18, connecting together free ends 22, 22 to form a continuous loop, pulling upon lace 20 at loop segment 28 to bring together the portions 11 and 13 of upper footwear portion 14 through which lace 20 is threaded, and securing wheel lock-type cord fastener 26 so as to releasably lock two lace portions of lace 20 in proximity to one another. In this way, the portions 11 and 13 of upper footwear portion 14 which define apertures 18 may be brought into proximity to one another, and their separation is inhibited. Shoe 10 may thus be secured rapidly and efficiently to a foot without tying free ends of a lace, and without dangling the free ends of a lace at the lateral side of the shoe, all with very little required in the way of manipulation to releasably secure the wheel lock-type cord fastener.

Each and every U.S. patent or other printed publication referred to herein is incorporated by reference as if fully set forth herein to the maximum extent permitted as a matter of law.

The particular dimensions of the component parts of the apparatus and footwear of invention may vary widely and do not constitute a limitation of this invention. This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law. In the claims, means-plus-function clauses are intended to cover the structures described herein as performing the cited function and not only structural equivalents but also equivalent structures.

What is claimed:

1. A lacing apparatus comprising:

a. a lace comprising a first end and a second end, said lace having a length sufficient to be threaded through a plurality of apertures defined by at least two portions of one or more articles;

b. a releasable clamp comprising, respective input apertures that receive said first and said second ends of said lace, and respective output apertures through which said first and said second ends of said lace pass, wherein, when at least one of said first and said second ends of said lace are pulled through said respective input and output apertures, said releasable clamp releasably secures said lace inward on the length of said lace from said at least one of said first and said second ends; and c. a locking mechanism adapted to releasably receive said lace so that a portion of said lace forms a loop between said first end and said second end of said lace at a first end of said locking mechanism, and said locking mechanism being adapted to allow for the adjustment of the length of said loop.

2. The lacing apparatus of claim 1, wherein said lace is an elastic material.

3. The lacing apparatus of claim 2, said releasable clamp further comprising a plurality of gripping surfaces for releasably securing said first and said second ends of said lace.

4. The lacing apparatus of claim 1, said releasable clamp further comprising a hook for releasably securing said loop to said releasable clamp.

5. The lacing apparatus of claim 3, said locking mechanism further comprises a body and a wheel, wherein said wheel is slidably received by said body so as to releasably secure said lace within said body.

6. The lacing apparatus of claim 3, wherein said respective output apertures are combined to form a single output aperture.

7. Footwear comprising:

a. a sole;

b. an upper portion connected to said sole and defining a plurality of apertures;

c. a lace having a first end and a second end, said lace having a length sufficient to be threaded through said plurality of apertures;

d. a releasable clamp located at a first side of said plurality of apertures, wherein, when at least one of said first and said second ends of said lace are pulled through said releasable clamp, said releasable clamp releasably secures said lace inward on the length of said lace from said at least one of said first and said second ends; and e. a locking mechanism comprising a body and a wheel, wherein said wheel is slidably received in said body so as to releasably secure said lace within said body so that a portion of said lace forms a loop between said first end and said second end of said lace at a first end of said locking mechanism, and said locking mechanism being adapted to allow for the adjustment of the length of said loop.

8. The lacing apparatus of claim 7, wherein said lace is an elastic material.

9. The lacing apparatus of claim 8, said releasable clamp further comprising respective input apertures that receive said first and said second ends of said lace, and respective output apertures through which said first and said second ends of said lace pass.

10. The lacing apparatus of claim 9, said releasable clamp further comprising a plurality of gripping surfaces for releasably securing said lace inward on the length of said lace from said first and said second ends of said lace.

11. The lacing apparatus of claim 9, wherein said respective output apertures are combined into a single output aperture.

12. The lacing apparatus of claim 7, said releasable clamp further comprising a hook for releasably securing said loop to said releasable clamp.

13. The lacing apparatus of claim 7, wherein said body and wheel form a wheel lock type cord fastener.

14. A method of lacing footwear having a portion that defines opposing edges in which a series of apertures are formed, said method comprising:

a. passing a lace through the apertures across the opposing edges so that tightening the lace tends to pull the opposing edges toward each other, wherein the lace has a first end and an opposite second end;

b. locking together at least two points along the length of the lace, the at least two points being between the first end and the second end of the lace so that a loop is formed between the at least two points;

c. securing the first end and the second end of the lace in a releasable clamp having respective input apertures for receiving the first and second ends of the lace, respective output apertures through which the first and second ends of the lace are passable and a plurality of gripping surfaces that releasably secure the lace in the releasable clamp;

d. selecting the at least two points along the length of the lace so that the loop is formed to a desired length; and e. passing at least one of the first end and the second end of the lace through its respective input and output apertures of the releasable clamp so that a sufficient amount of the lace passes therethrough to define a desired length of the lace.

15. The method of claim 14, said method further comprising securing the loop to the releasable clamp.

16. The method of claim 14, wherein step (b) includes securing together two points along the length of the lace in a cord fastener.

17. The method of claim 16, wherein step (d) includes sliding the cord fastener toward or away from the first and second ends of the lace to respectively increase or decrease the length of the loop.

18. The method of claim 14, wherein step (a) includes initially threading the first and second ends of the lace through the footwear apertures furthest from a toe end of the footwear so that the first and second ends of the lace finally thread through footwear apertures proximate the toe end and so that the at least two points are located proximate the footwear apertures furthest from the toe.

19. The method of claim 14, said method further comprising, following step (e), cutting an excess length of lace from the at least one of the first and second ends of the lace.

20. A shoe lacing apparatus comprising:

a. a lace having a first end and a second end, said lace having a length sufficient to be threaded through a plurality of apertures defined on opposing edges of a portion of a shoe so that tightening the lace tends to pull the opposing edges toward each other;

b. a releasable clamp defining, respective input apertures that receive said first and said second ends of said lace, and respective output apertures through which said first and said second ends of said lace pass;

c. a plurality of gripping surfaces between said respective input and output apertures that releasably engage said lace, wherein said gripping surfaces prevent said first and said second ends of said lace from passing through said releasable clamp from said output apertures toward said input apertures when said gripping surfaces engage said lace; and d. a locking mechanism comprising a body defining an input and an output, said body adapted to releasably receive said lace so that a portion of said lace between said first and second ends of said lace forms a loop at a first end of said locking mechanism, wherein said locking mechanism is adapted to allow for the adjustment of the length of said loop.

21. The lacing apparatus of claim 20, wherein said lace is an elastic material.

22. The lacing apparatus of claim 21, wherein said plurality of gripping surfaces allow said first and said second ends of said lace to pass through said respective output apertures when said plurality of gripping surfaces are disengaged.

23. The lacing apparatus of claim 20, wherein said respective output apertures are combined into a single output aperture.

24. The lacing apparatus of claim 20, wherein said locking mechanism is a wheel lock type cord fastener.

25. The lacing apparatus of claim 20, said locking mechanism further comprises a pusher, wherein said pusher is slidably received by said housing so as to releasably secure said lace within said housing.

26. The lacing apparatus of claim 20, said locking mechanism further comprises a wheel, wherein said wheel is slidably received by said housing so as to releasably secure said lace within said housing.

27. A lacing apparatus comprising:

a. a lace having a first end and a second end, said lace having a length sufficient to be threaded through a plurality of apertures defined by at least two portions of one or more articles;

b. a releasable clamp comprising respective input apertures that receive said first and said second ends of said lace, and respective output apertures through which said first and said second ends of said lace pass, wherein, when at least one of said first and said second ends of said lace are pulled through said respective input and output apertures, said releasable clamp releasably secures said lace inward on the length of said lace from said at least one of said first and said second ends; and c. a locking mechanism comprising a body and wheel, wherein said body defines an input and an output aperture and said wheel releasably secures said lace within said body so that a portion of said lace forms a loop between said first end and said second end of said lace at a first end of said body, and said locking mechanism being adapted to allow for the adjustment of the length of said loop.

28. Footwear comprising:

a. a sole;

b. an upper portion connected to said sole and defining a plurality of apertures;

c. a lace having a first end and a second end, said lace having a length sufficient to be threaded through said plurality of apertures;

d. a releasable clamp located at a first side of said plurality of apertures, said releasable clamp comprising a first and a second input aperture, wherein, when at least one of said first and said second ends of said lace are received in said first or said second input apertures, said releasable clamp secures said at least one of said first and said second ends of said lace in said releasable clamp; and e. a locking mechanism comprising a body and a wheel, wherein said wheel is slidably received in said body so as to releasably secure said lace within said body so that a portion of said lace forms a loop between said first end and said second end of said lace at a first end of said locking mechanism, and said locking mechanism being adapted to allow for the adjustment of the length of said loop.

29. The lacing apparatus of claim 28, wherein said lace is an elastic material.

30. The lacing apparatus of claim 28, said releasable clamp further comprising a hook for releasably securing said loop to said releasable clamp.

31. The lacing apparatus of claim 28, wherein said body and wheel form a wheel lock type cord fastener.

* * * * *